United States Patent [19]

Abbey

[11] Patent Number: 4,895,184

[45] Date of Patent: Jan. 23, 1990

[54] FLUID SERVO SYSTEM FOR FUEL INJECTION AND OTHER APPLICATIONS

[76] Inventor: Harold G. Abbey, 12735 Headwater Cir., Wellington, Fla. 33414

[21] Appl. No.: 135,738

[22] Filed: Dec. 21, 1987

[51] Int. Cl.[4] ..... F02M 39/00

[52] U.S. Cl. ..... 137/625.29; 123/452; 123/463

[58] Field of Search ..... 123/452, 459, 463, 453–455; 137/85, 625.29

[56] References Cited

U.S. PATENT DOCUMENTS

| | | | |
|---|---|---|---|
| 2,924,206 | 2/1960 | Groves | 123/463 |
| 2,957,467 | 10/1960 | Ball | 123/463 |
| 2,992,643 | 7/1961 | Ball | 123/463 |
| 3,411,538 | 11/1968 | Gruner | 137/625.29 |
| 3,472,214 | 10/1969 | Moon | 137/625.29 |
| 3,509,998 | 5/1970 | Pellett | 137/625.29 |
| 3,526,251 | 9/1970 | Rosaen | 137/625.29 |
| 3,820,517 | 6/1974 | Nambu | 123/463 |
| 4,275,691 | 6/1981 | Wolff | 123/385 |
| 4,290,451 | 9/1981 | Fleckstein | 137/625.29 |
| 4,370,967 | 2/1983 | Gmelin | 123/452 |

FOREIGN PATENT DOCUMENTS

| | | | |
|---|---|---|---|
| 113297 | 6/1941 | Australia | 123/463 |

*Primary Examiner*—Carl Stuart Miller

*Attorney, Agent, or Firm*—Malin, Haley & McHale

[57] ABSTRACT

A fuel injection system for a spark-ignition internal combustion engine in which combustion air is fed through an air flow meter to produce an input force whose strength is proportional to the mass-volume of the air. This input force actuates the valve member of a valve mechanism to whose input is supplied fuel at constant pressure, the valve member being displaced to an extent determined by the strength of the input force. The valve mechanism includes a fuel output chamber in which the pressure of fuel therein is a function of valve member displacement, this pressure being applied as a countervailing force to the valve member to cause it to assume a null-balance position at which the resultant mean fuel pressure yielded by the output chamber is proportional to the mass-volume of the combustion air, thereby attaining optimum fuel-air ratio conditions throughout a broad operating range.

10 Claims, 8 Drawing Sheets

FLUID SERVO SYSTEM FOR FUEL INJECTION AND OTHER APPLICATIONS'

BACKGROUND OF INVENTION

1. Field of Invention

This invention relates generally to fluid servo systems, and more particularly to a servo-controlled fuel injection system for an internal combustion engine to produce optimum fuel-air ratio throughout a broad operating range.

2. Status of Prior Art

The behavior of an internal combustion engine in terms of operating efficiency, fuel economy and emission of pollutants is directly affected both by the fuel-air ratio of the combustible charge and the degree to which the fuel is vaporized and dispersed in air. Under ideal circumstances, the engine should at all times burn 14.7 parts of air to one part of fuel within close limits, this being the stoichiometric ratio. In the actual operation of a conventional system, a ratio richer than stoichiometric is required at idle and slow speeds for dependable operation, whereas leaner than stoichiometric is desirable at higher speeds for reasons of economy. The employment of Lambda oxygen exhaust sensors and feedback controls to maintain the stoichiometric ratio for catalytic control of emissions is at the expense of performance and economy.

Maximum fuel economy and minimum emission of pollutants have heretofore been considered to be mutually exclusive due to the practical limitations of presently available systems. These limitations stem from the inability to "gasify" liquid fuel in air from idle to full speed and power before ignition in the engine. By the term "gasify" is meant fuel that has been dispersed, vaporized and homogenized to a gaslike quality. At or about the stoichiometric ratio of such gasified air-fuel mixtures, the most complete combustion with minimum emissions will result.

Fuel preparation systems for spark-ignition internal combustion engines fall into two general classes: carburetors and fuel injection. These will now be separately considered.

The function of a carburetor is to produce the fuel-air mixture needed for the operation of an internal combustion engine. In the carburetor, fuel is introduced in the form of tiny droplets in a stream of air, the droplets being vaporized as a result of heat absorption in a reduced pressure zone on the way to the combustion chamber whereby the mixture is rendered inflammable. In a conventional carburetor, air flows into the carburetor through a Venturi tube and a fuel nozzle within a booster Venturi concentric with the main Venturi tube. The reduction in pressure at the Venturi throat causes fuel to flow from a float chamber in which the fuel is stored through a fuel jet into the air stream. The fuel is atomized because of the difference between air and fuel velocities.

Although most carburetors today use double and triple Venturis to multiply suction forces, the fixed sizes of these Venturis, usually determined by the mid-range capacity of the engine, gives rise to fuel induction throughout approximately one-half the automotive operating range. The lack of Venturi-carburetion action at idle and slow speeds makes it necessary to introduce fuel downstream of the Venturi by means of the high vacuum developed by partially-open throttle plates. At higher speeds and power, air bleeds are needed to moderate excessive enrichment by the higher Venturi velocities. And under maximum power when the Venturi vacuum is moderate, additional fuel is supplied by means of power jet, stepped needle valves or auxiliary barrels.

Thus existing techniques for regulating the fuel-to-air ratio throughout the existing range from idle to full power represent, at best, a compromise dictated by the above-noted limitations, fuel efficiency being poor at idle, low speeds and high power. Moreover, to overcome acceleration "flat spots" encountered during transitions in driving modes, throttle-actuated fuel pumps are employed to spray additional fuel into the air stream, thereby rendering the system even less efficient.

Modern systems of fuel injection for internal combustion engines produce air-fuel mixtures by means of pressurized fuel nozzles for timed or continuous spray into the air stream. Fuel injection systems are now widely used, for they make possible precise metering and control of the air-fuel ratio over the entire engine operating range, thereby promoting fuel efficiency. Moreover, fuel injection lends itself to the application of afterburning exhaust equipment to reduce the emission of noxious pollutants. Most fuel injection systems in current use are electronically controlled, though mechanical injection systems are also found in some engines.

An electronic fuel injection system includes an electrically-driven fuel pump which supplies and develops the fuel pressure necessary for the system. The fuel is injected by solenoid-operated fuel injection valves into the cylinder intake ports, characterizing such systems as "ported" Electronic Fuel Injection (EFI). The injection valves are controlled by an Electronic Control Unit (ECU) which governs the amount of fuel injected by the length of time they stay open from a constant pressure source. The ECU is provided with data regarding operating conditions and ambient conditions by means of sensors.

Mechanical fuel injection systems are of two general types; those requiring a drive from the engine and those that do not. The engine driven systems comprise a fuel injection pump with an integral governor, the same as that for Diesel engines. The prevailing mechanical injection system needs no direct drive and injects continuously from a constant pressure electric pump fuel supply with regulators that control the amount of fuel injected by varying the fuel pressure to injectors.

The yardstick for determining the quantity of fuel required for all fuel injection systems is the quantity of air drawn in by the engine. Hence an air-flow meter is the important component for controlling the quantity of injected fuel. The function of air-flow sensing and measuring is carried out by various forms of air-flow meters. Presently such meters are either mechanical in the form of a plate movable by air flow in a Venturi-like engine air intake casing, or mechanical-electrical in the form of a "vane" movable in the engine air intake whose movement is transduced to an electric signal by mechanical switching. Also in use are electronic meters such as "hot-wire" and "sonic" sensing for operation in conjunction with microprocessors.

In the Bosch K Jetronic system, a "movable-plate" sensor directly positions a plunger valve in a barrel containing metering slits whereby the plunger opens or closes slits for mor or less fuel flow to individual cylinders from a primary (constant) pressure source. Variation of fuel-to-air ratio is achieved by a variable "control" pressure that biases the plunger movement against air-flow movement—a continuous multi-port injection system.

In the Bosch L Jetronic system, a "vane"-to-electric air-flow meter and various engine and ambient electronic sensors input to an electronic microprocessor (ECU) to control the output of electric-solenoid injector-valves in an electronic multi-port injection system. The other Electronic Fuel Injection (EFI) systems are basically the same, using other forms of electronic air-flow meters.

A mechanical fuel injection system included in an Indianapolis 500 winner in 1970 and still popular with such vehicles makes use of a mechanical air flow meter consisting of a Venturi in the turbo-charged engine intake. Its differential-air pressure (Venturi-vacuum) is applied to a diaphragm whose movement is opposed by differential-fuel pressure of an orifice type jet on an opposing diaphragm, the resultant movement of a valve controlling fuel pressure to individual ported injectors continuously. The non-linear flow characteristics of this system results in poor control at the low end and results in undue enrichment at the high end, thereby rendering this system unusable for passenger and commercial vehicles.

The Abbey series of U.S. Pat. Nos. 4,118,444; 4,187,805; 4,250,856; 4,308,835 and 4,387,685 discloses a unique "floating" Venturi structure that when positioned in the air-intake to the engine produces a pneumatic pressure-differential whose magnitude is linearly proportional to the mass-volume of air flowing therethrough and is effective throughout the entire operating range of the modern high-speed engine. This constitutes a mechanical air-flow meter that provides a pneumatic signal that is applicable to mechanical fuel regulation for fuel-to-air proportioning control.

The above-identified patents, whose disclosures are incorporated herein by reference, also disclose continuous injection systems that utilize the "floating" Venturi meter controlling fuel injection by means of a fuel pressure regulator. They also disclose the use of a non-electric injector discharging into the center of the "floating" Venturi structure. Such a single-point, continuous injection system confers the benefits of one large injector into the low pressure, high velocity air stream with time to disperse, evaporate and homogenize the air-fuel mixture before entry into combustion regions.

All fuel injection systems include air-flow metering devices to control the quantity of fuel discharged through throttle flow devices called "injectors." These devices transform liquid fuel into a spray of finely divided particles or droplets which commingle with combustion air in an engine to form an ignitable mixture. These are referred to as injection nozzles and electric-injectors. Electric-injectors consist of a solenoid-operated valve which quantifies flow into a nozzle from a constant pressure source by the amount of time it is opened.

The nozzle function of discharging and breaking up fuel into engine combustion air is based upon the pressure energy dissipated therein and fuel quantity discharged is proportional to the pressure drop from inflow pressure to the prevailing air pressure at point of discharge. Therefore, injection nozzles of any design, sized for a specific application will discharge fuel quantity in proportion to pressure drop and considering that air pressures at discharge are very small relative to fuel pressures, fuel quantity discharged will vary proportionately to the fuel pressure applied.

Presently, all systems of fuel injection that effect "closed-loop" control of air-fuel ratio do so by means of an exhaust gas electronic sensor, the Lambda Oxygen Exhaust Sensor. This "Lambda" method measures the exhaust gas content after combustion then feeds back deviation from the norm to control of fuel quantity injected before combustion. This system can only average optimum ratio with wide variations resulting from the time span from exhaust sampling to fuel quantity injected.

The advantages of closed-loop control of air-fuel mixture ratio can only be obtained by the air-flow controlling fuel flow in real time before combustion to a predetermined ratio norm and the capability of adjusting the ratio norm to operating conditions. This method of control implies some form of "servo" system by which is inferred "feed-forward" of air-flow into the engine and "feed-back" of fuel flow or their equivalents in real time before combustion.

SUMMARY OF INVENTION

In view of the foregoing, the main object of this invention is to implement "closed-loop" fuel injection for spark-ignition engines whereby mechanical metering of engine air intake acts to control fuel injection thereto by means of a mechanical fluid servo system of fuel injection.

More particularly, an object of this invention is to provide a fluid servo system wherein a linear displacement signal from a device metering one fluid is applied to the servo system regulating a second fluid, resulting in second fluid output at a pressure that is proportional to the mass-volume of the metered fluid, whereby by means of a flow-throttling device, the mass-volume output of the regulated second fluid is proportional to the mass-volume of the metered fluid.

In the context of fuel injection systems for spark-ignition engines, an object of this invention is to apply the fluid-servo system to a mechanical, non-electronic continuous fuel injection system whereby a mechanical air-flow metering device's displacement signal applied to the fuel-servo system affords proportional output fuel pressure from a constant pressure source which discharges through nozzle injectors into the metered air-flow into the engine, resulting in optimum air-fuel ratio.

It is another object of this invention to provide means to transform a fluid-metering signal that is in differential-pressure form proportionate to mass-volume of the metered fluid into a linear displacement signal so that it may be applied to the fluid servo system to regulate fuel injection in a continuous injection system for spark-ignition engines.

Yet another object of this invention is to provide a fluid servo system that accepts a differential pressure signal of one fluid to amplify and control the output pressure of another fluid in proportion to said signal pressure to produce high fluid output pressures to control pneumatic and hydraulic actuation and positioning devices.

Also an object of this invention is to provide means to vary the response characteristic of such fluid-servo operating systems whereby the output to input proportionality is varied to suit transient operating conditions.

Still another object of this invention is to apply the "floating" Venturi structure to a fluid servo system whereby optimum air-fuel ratio and a high degress of homogenization of the mixture is obtained with a single point continuous fuel injection system to a spark-ignition engine with fluid-mechanical components yielding high thermal efficiency with non-electronic reliability and low cost.

Briefly stated, these objects are attained in a fuel injection system for a spark-ignition internal combustion engine in which combustion air is fed through an air flow meter to produce an input force whose strength is proportional to the mass-volume of the air. This input force actuates the valve member of a valve mechanism to whose input is supplied fuel at constant pressure, the valve member being displaced to an extent determined by the strength of the input force. The valve mechanism includes a fuel output chamber in which the pressure of fuel therein is a function of valve member displacement, this pressure being applied as a countervailing force to the valve member to cause it to assume a null-balance position at which the resultant mean fuel pressure yielded by the output chamber is proportional to the mass-volume of the combustion air, thereby attaining optimum fuel-air ratio conditions throughout a broad operating range.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

The Basic Servo System

Figure 1:
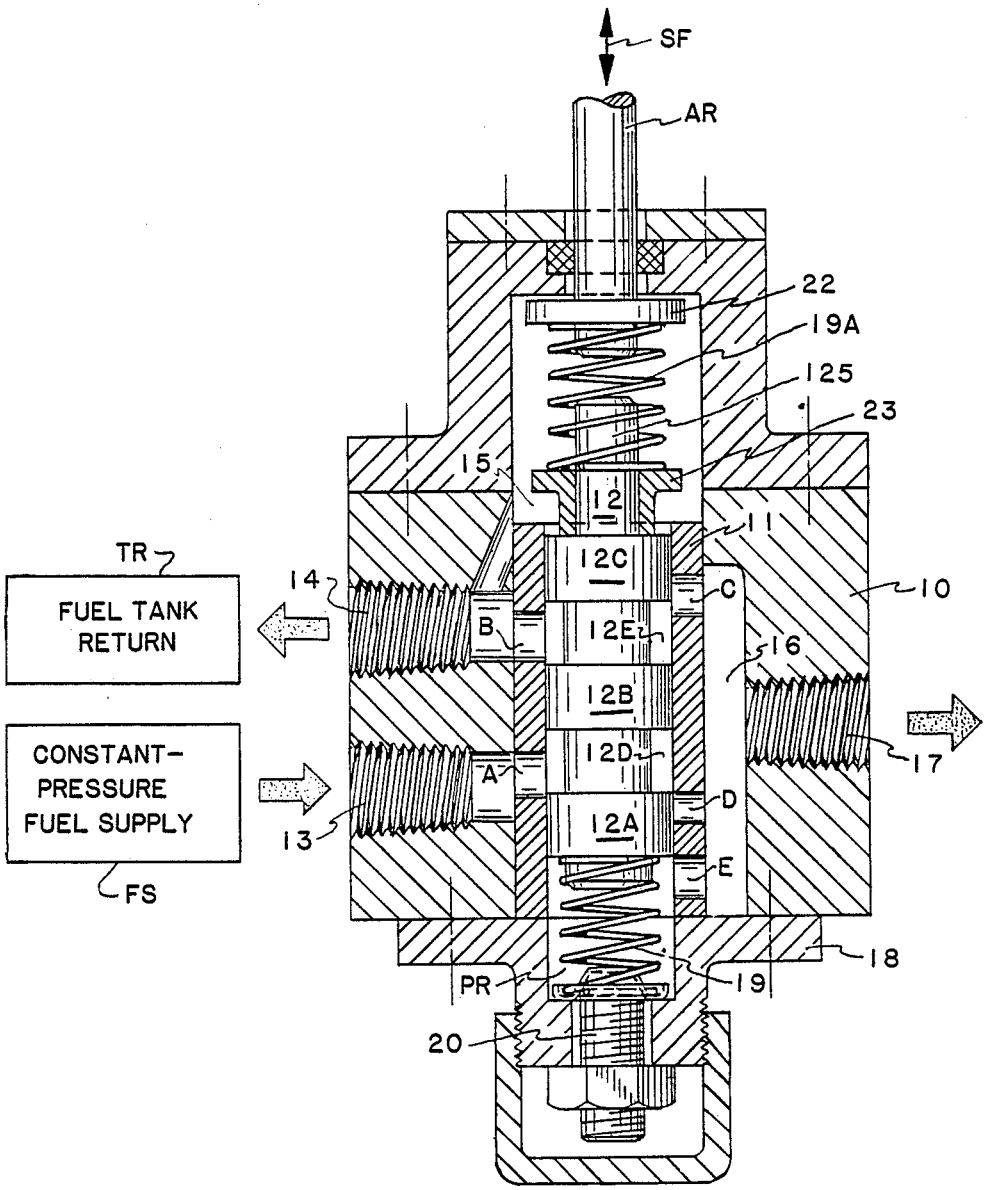
FIG. 1 is a sectional view of a valve mechanism which in combination with a signal input device creates a fluid servo system in accordance with the invention.

Referring now to FIG. 1, there is shown a valve mechanism which in combination with a signal input device creates a fluid servo system in accordance with the invention.

The valve mechanism includes a valve body 10 having a cylindrical sleeve 11 fitted therein within which is axially slidable a valve member in the form of a spool 12. Sleeve 11 is provided with ports A and B on one side thereof and with ports C, D and E on its opposite side. Port A communicates with a bore 13 in valve body 10 that is pipe-tapped for connection to a constant-pressure fuel supply, represented by block FS. Port B communicates with a bore 14 pipe-tapped for connection to a fuel-tank return, represented by block TR. Bore 14 also communicates through a duct in the valve body with an upper valve cavity 15.

Ports C, D and E all feed into a common output chamber 16 within the valve body, chamber 16 communicating with an outlet bore 17 which is pipe-tapped for fluid discharge into various utilization devices, as will be hereinafter explained.

Spool 12 is constituted by three like cylinders 12A, 12B and 12C whose diameters substantially match the internal diameter of sleeve 11, the cylinders being mounted at equi-spaced positions on a valve stem 12S. The annular space between the first and second cylinders 12A and 12B define a lower valve region 12D, and that between the second and third cylinders 12B and 12C an upper valve region 12E.

The lower end of valve body 10 is sealed by a cap 18 to define a countervailing pressure region PR below cylinder 12A, this region communicating through port E with output chamber 16. Interposed in pressure region PR between the lower end of valve stem 28 and a set screw 20 threadably received in cap 18 is a helical spring 19 to provide an adjustable bias for spool 12. The upper end of spool 12S is coupled to an actuator rod AR by means of a helical spring 19A; hence when the rod is axially advanced by an input signal force SF, it acts to displace spool 12S to an extent determined by the strength of this force.

Sleeve port A is so dimensioned and located with respect to lower valve region 12D between valve cylinders 12A and 12B that within the operating range in which the valve spool 12 is axially displaced, flow from the constant-pressure fuel supply FS through bore 13 into port A is never cut off.

Sleeve ports C and D are so dimensioned and positioned that when valve cylinder 12A is displaced to cover port D to cut off flow into common output chamber 16, port C is then uncovered by cylinder 12C to expose valve region 12E to relieve fuel pressure in output chamber 16. Valve region 12E is always open through port B and tank-return bore 14, thereby effectively reducing output pressure to a minimum which is pipeline resistance to an open tank.

Port E which admits fluid from output chamber 16 into countervailing pressure region PR below cylinder 12A is always open, the degree of countervailing pressure being determined by the fluid pressure prevailing in output chamber 16.

Operation

Figure 4:
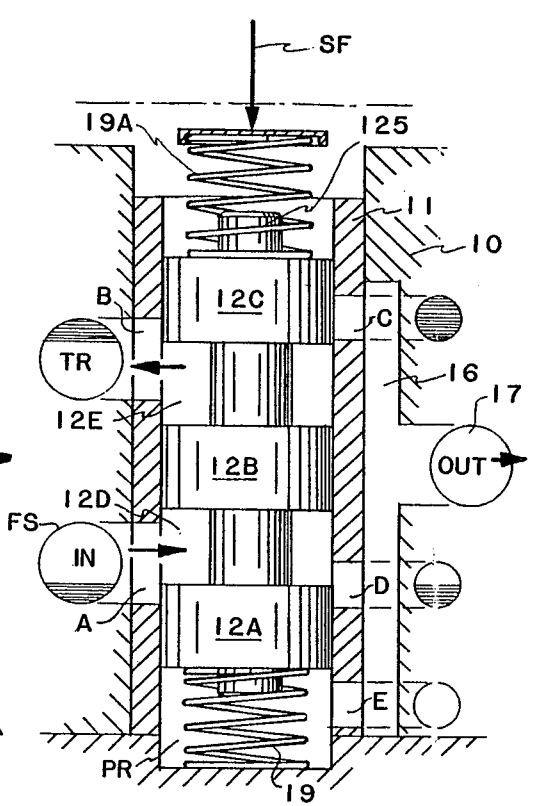
FIG. 4 shows the valve mechanism when its valve member is axially positioned to yield output fluid at maximum pressure.
Figure 3:
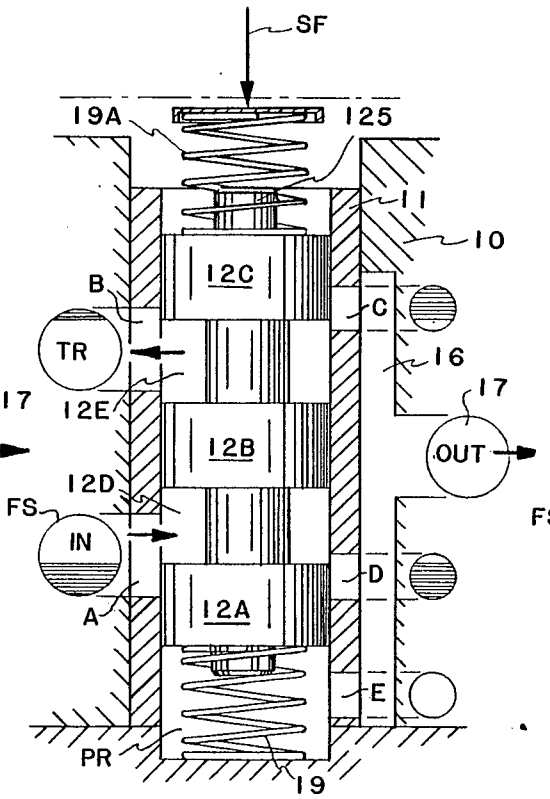
FIG. 3 illustrates the valve mechanism when its valve member is axially positioned to yield output fluid at medium pressure.
Figure 2:
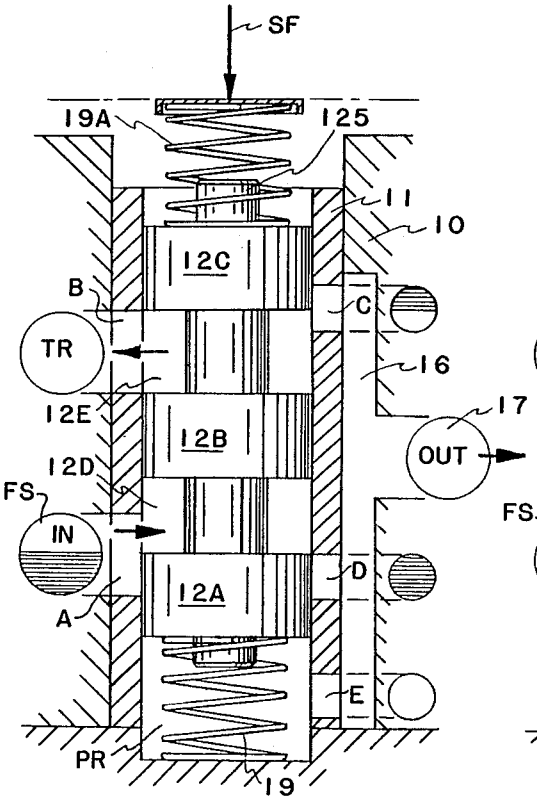
FIG. 2 illustrates the valve mechanism when its valve member is axially positioned to yield output fluid at minimum pressure.

We shall now in connection with FIGS. 2, 3 and 4 consider three distinct operating conditions; the first being minimum fuel output pressure from valve discharge outlet 17; the second being medium output pressure, and the third maximum output pressure. It will be seen in FIG. 2 that valve stem 12S has been axially displaced by an input signal force SF to the degree that its upper end is somewhat above the upper end of sleeve 11, while in FIG. 3, the displacement is such as to bring the upper end of the valve stem in line with the upper end of sleeve 11. And in FIG. 4, the displacement is such as to bring the upper end of the valve stem 12S somewhat below the upper end of sleeve 11. Hence the relationship of the valve cylinders 12A, 12B and 12C to ports A to E is progressively changed as one increases or decreases the input force.

In the minimum output of the valve mechanism shown in FIG. 1, the input signal force SF displaces spool 12 against the tension of spring 19 to shut off port D and to open port C. Hence constant-pressure fuel from source FS admitted into port A to fill lower valve region 12D is blocked from entering output chamber 16, whereas fuel from the output chamber 16 is permitted to return to the fuel tank return TR by way of partially-open port C, upper valve region 12E and port B. Thus fluid pressure in output chamber 16 is now at its lowest level.

In the medium output pressure condition shown in FIG. 3, port D is partly open to admit pressurized fuel from supply FS into output chamber 16, port C then being partially open to permit the return of fuel to the fuel return tank TR. The position assumed by valve spool 12 is the result of the displacement effected by the input signal SF whose force is applied to valve stem 12S and the countervailing force applied to the underface of cylinder 12A by fluid pressure admitted from output chamber 16 through port E into countervailing pressure chamber PR.

In operation, valve spool 12 seeks an axial null position within sleeve 11 in which the input signal force is balanced by the countervailing force. This yields in the output of the valve mechanism a mean fuel discharge pressure which varies linearly in proportion to the imposed signal force.

Thus in a fluid servo system in accordance with the invention, the valve mechanism whose fluidic input is fuel (or any other fluid) at a constant pressure is responsive to an input force which axially displaces the spool of the valve mechanism to an extent determined by the strength of the signal from an air flow meter or any other metering device producing a varying input force to yield fuel in the outlet of the mechanism whose pressure is proportional to the input force.

In FIG. 4 where the mean pressure yielded by the valve mechanism is at a maximum value, it will be seen that port C is closed by cylinder 12C; hence there is no flow of fuel from output chamber 16 back to return tank TR. Port D is at the same time half-open to admit pressurized fuel into the output chamber 16, and to admit a portion of this pressurized fuel from the output chamber into the countervailing pressure chamber PR to cause the spool to assume a null-balance position providing maximum output. At no time, in any state of the valve mechanism, are ports A and B closed.

Displacement Signal Device

Figure 5:
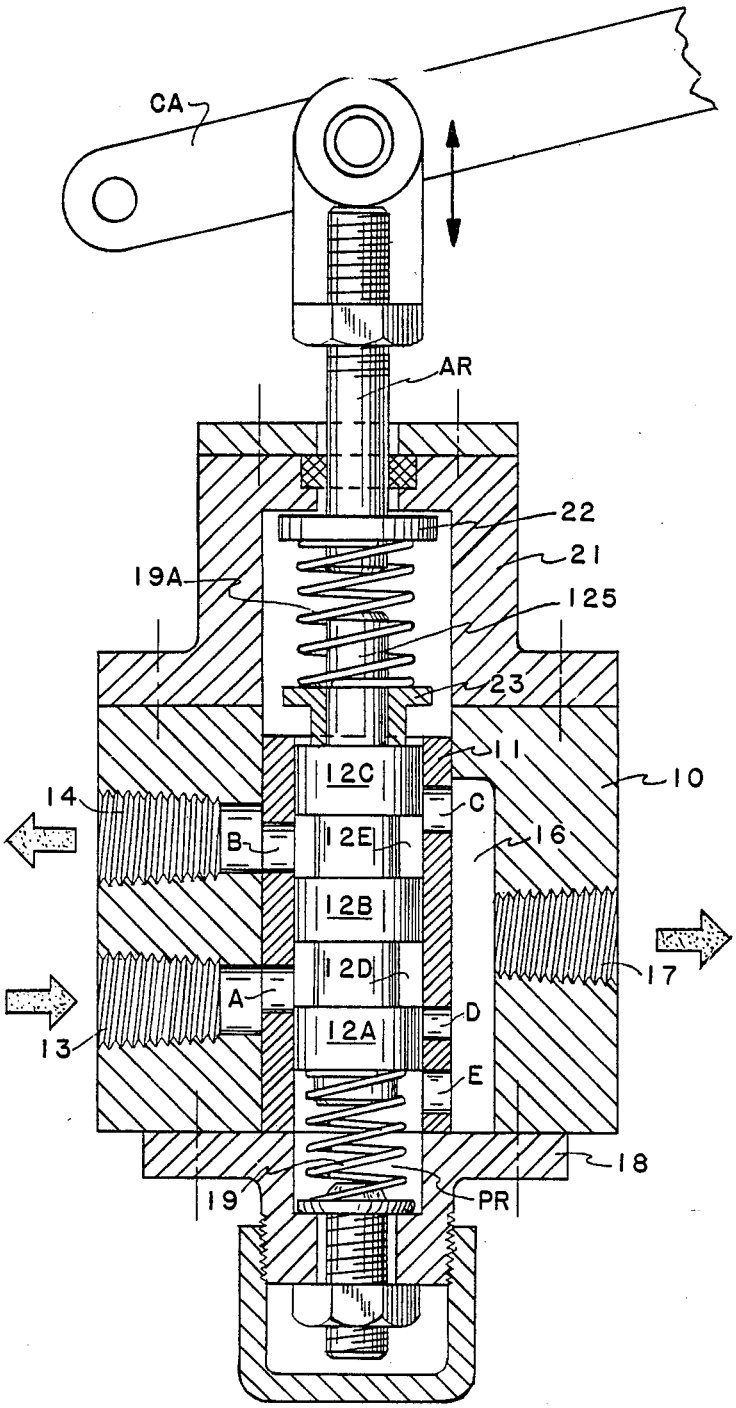
FIG. 5 shows a displacement signal device associated with the valve mechanism.

Referring now to FIG. 5, there is shown a valve mechanism similar to that shown in FIG. 1, the upper end of valve stem 12S being enclosed by a cap 21 on which is supported for sliding movement the actuator rod AR which extends outside of cap 21 and is pivotally coupled to the crank arm CA of a displacement signal device. A flanged bushing 23 is mounted on valve stem 12S, with its flange facing a flange 22 affixed to the end of actuator rod AR. Spring 29A is in compression between the two flanges to force spool 12 to a position determined by the length of bushing 23 before it bears against the upper end of sleeve 11. At this limiting position of valve spool 12, port D is closed by cylinder 12A, and port C is open to valve region 12E which communicates with tank-return bore 14.

In operation, a flowmeter coupled to crank CA acts to axially displace actuator rod AR to an extent proportional to the metered flow whereby the rod tensions spring 19A accordingly. The tensioned spring 19A moves valve stem 12S through bushing 23, thereby establishing inflow and outflow from output chamber 16 to produce a fluid pressure therein which is communicated by port E to countervailing pressure chamber PR to counteract the metering force, thereby causing the valve spool to assume a null-balance position at a mean output fluid pressure.

Differential Air-Pressure Unit

Figure 7:
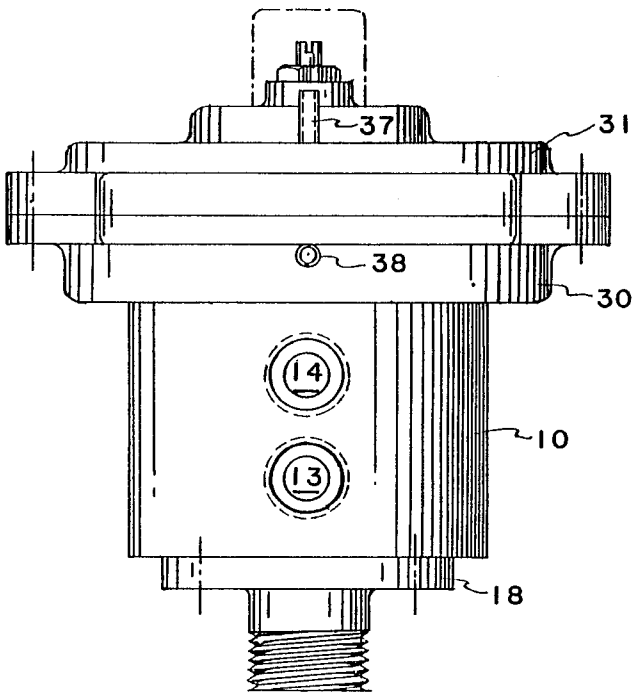
FIG. 7 is an elevational view of the air pressure unit and valve mechanism.
Figure 6:
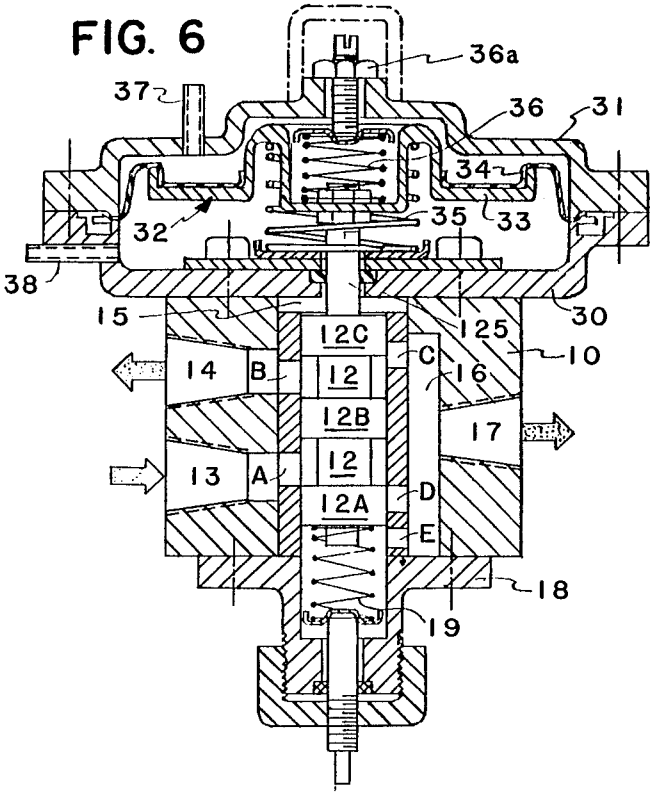
FIG. 6 is a sectional view of an air pressure unit associated with the valve mechanism.
Figure 8:
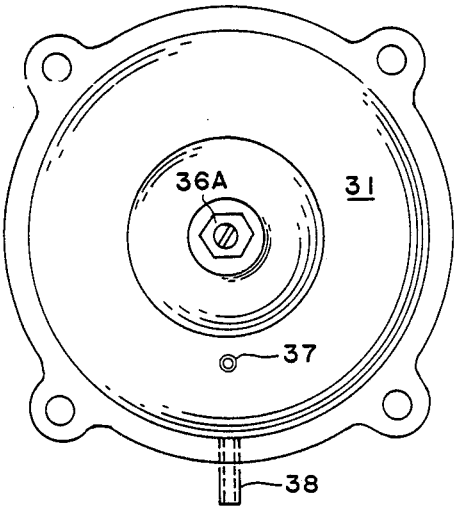
FIG. 8 is a top view of the air pressure unit.

Referring now to FIGS. 6, 7 and 8, there is shown a differential air-pressure unit that transforms a differential air-pressure signal to a proportional force which is applied to the valve mechanism to create a servo system for producing an output fluid pressure proportional to an imposed differential air pressure signal.

The unit includes two flanged circular casings 30 and 31 having a diaphragm-piston assembly 32 clamped therebetween to form hermetic chambers in the respective casings. Casing 30 is provided with a center opening and a flat outer surface for sealed mounting to body 10 of the valve mechanism. The valve stem 12S is extended to pass through the center of the opening.

The diaphragm-piston assembly 32 consists of a rigid circular frame 33 molded to receive the flexible flanged diaphragm 34 and coaxial nested recesses for spring 35 in chamber 30 and spring 36 in chamber 31. A flexible seal on valve stem 12S is clamped to casing 30, and valve stem 17 is coupled to the center of the frame 33 of the diaphragm-piston 32 whereby its lateral movement is transferred to valve spool 12.

Outer chamber 31 contains a spring 36 which is nested within spring 35 in the inner chamber 30 whereby the screw and locknut 36 adjust the tension of both springs. Outer chamber 31 is provided with a nipple 37 for connection to the higher pressure P1 of an air-flow meter and inner chamber 30 is provided with a nipple 38 for connection to the lower pressure P2 of an air-flow meter whereby the differential-pressure P1–P2 results in a force Fa equal to P1–P2 X Area of Diaphragm-piston 32. This signal force Fa applied to a valve mechanism of diameter Dv results in an output fluid pressure P3 of P1–P2 X Ad/Av; the differential-signal pressure multiplied by the ratio of Area of diaphragm-piston to Area of cylinder-spool valve.

This differential pressure unit makes it possible to use relatively small signal pressures to govern much higher output fluid pressures.

Fluid Servo Booster

Figure 9:
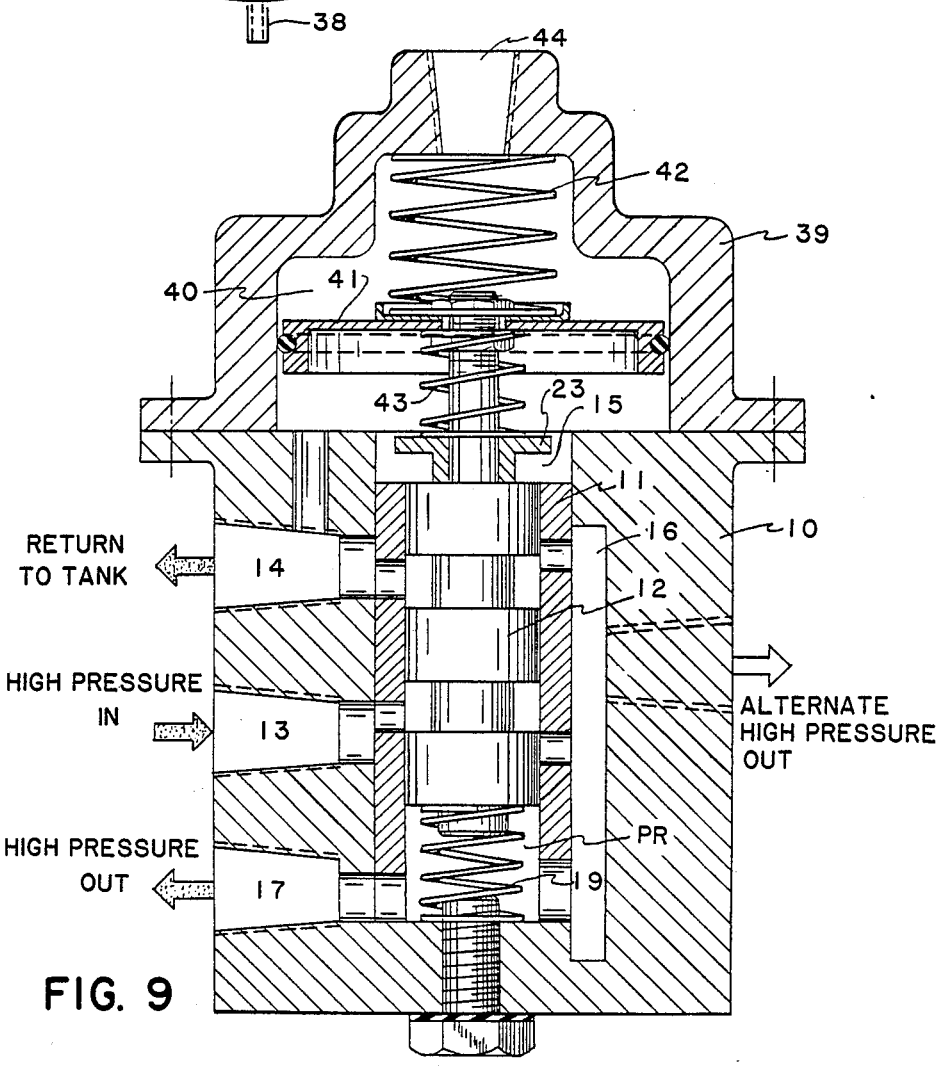
FIG. 9 shows a fluid servo booster.

FIG. 9 illustrates a fluid-servo booster system which accepts a varying pressure output from a low pressure system as an input to a second stage booster-servo to discharge a proportionate high pressure from a separate high constant pressure fluid source.

This booster consists of a casing 39 seal fastened to body 10 of the valve mechanism shown in FIG. 1. Casing 39 is provided with a cylindrical cavity 40 in which is mounted a slidably sealed piston 41 which is coupled to valve stem 12S whereby axial piston movement is transmitted to valve spool 12

A spring 42 in compression between casing 39 and piston 41 biases the piston-valve assembly in balance with tension of spring 42 in cavity 15 and valve biasing spring 19 in countervailing pressure chamber PR.

The output of a low-pressure servo system is ducted into piston-chamber 40 through connection 44 and a high-pressure source chamber is connected to 13 and tank return to 14 whereby output from chamber 16 is equal to pressure input 44 multiplied by the area of piston 41 divided by the area of valve spool 12.

In all other servo systems of this invention, the adjustment of spring tension at either end of the servo-valve serves to determine fluid ratio and initial pressures. This can be manually adjusted or adjusted automatically by a hydrostatic temperature controller.

Other sensing controllers such as vacuum motors and electro-magnetic linear motors are applicable for transient operational and ambient conditions.

Fuel Injection Systems

Figure 10:
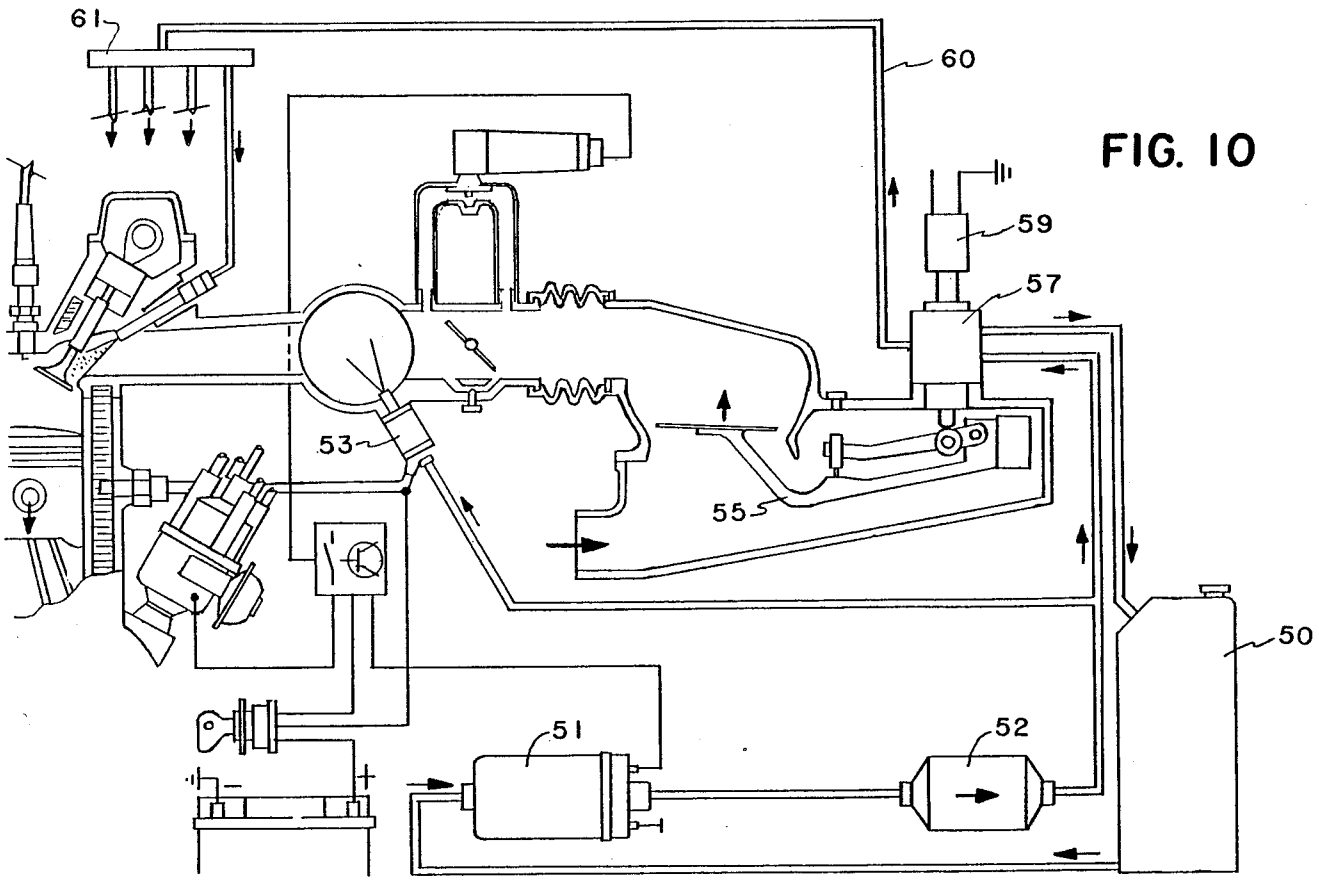
FIG. 10 shows a multi-port fuel injection system controlled by a fluid servo system according to the invention.

FIG. 10 is a schematic diagram of a Continuous Multi-port Fuel Injection system to a multi-cylinder engine. This system is composed of electric pump 51 and a filter 52 supplying a constant pressure fuel supply from tank 50. Pump pressure is supplied to a starting electric-injector 53 to the valve mechanism 57 of a fluid servo system utilizing the Bosch displacement air flow meter 55. The output of fuel servo 57 is discharged via line 60 to individual nozzle injectors 61 at each engine intake port. Servo unit 57 is adjustable for engine temperature control of air-fuel ratio by temperature switch control of an electromagnetic linear motor 59.

Figure 11:
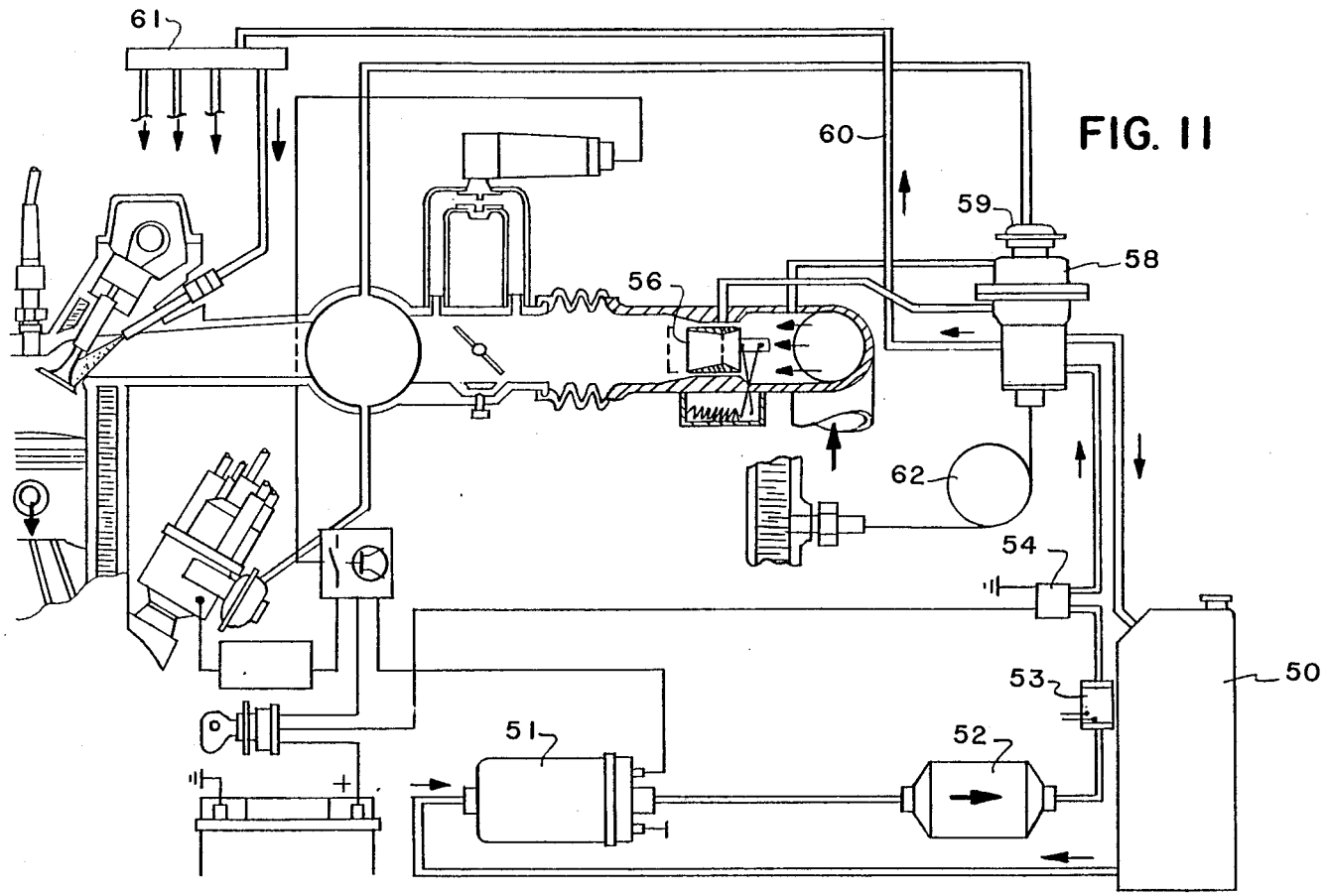
FIG. 11 is similar to FIG. 10, except that it uses differential air pressure derived from a floating Venturi meter.

FIG. 11 is a schematic diagram of a Continuous Multi-port Fuel Injection System utilizing the differential air pressure from an Abbey "floating" Venturi meter 56 to the pneumatic signal input fluid servo system unit 58. Fuel at proportional pressure is discharged to individual nozzle injectors at each engine intake port. In this system 62 is a hydrostatic engine temperature or thermo-wax controller and 59 is a vacuum motor adjust of fuel air ratio from manifold-vacuum.

Figure 12:
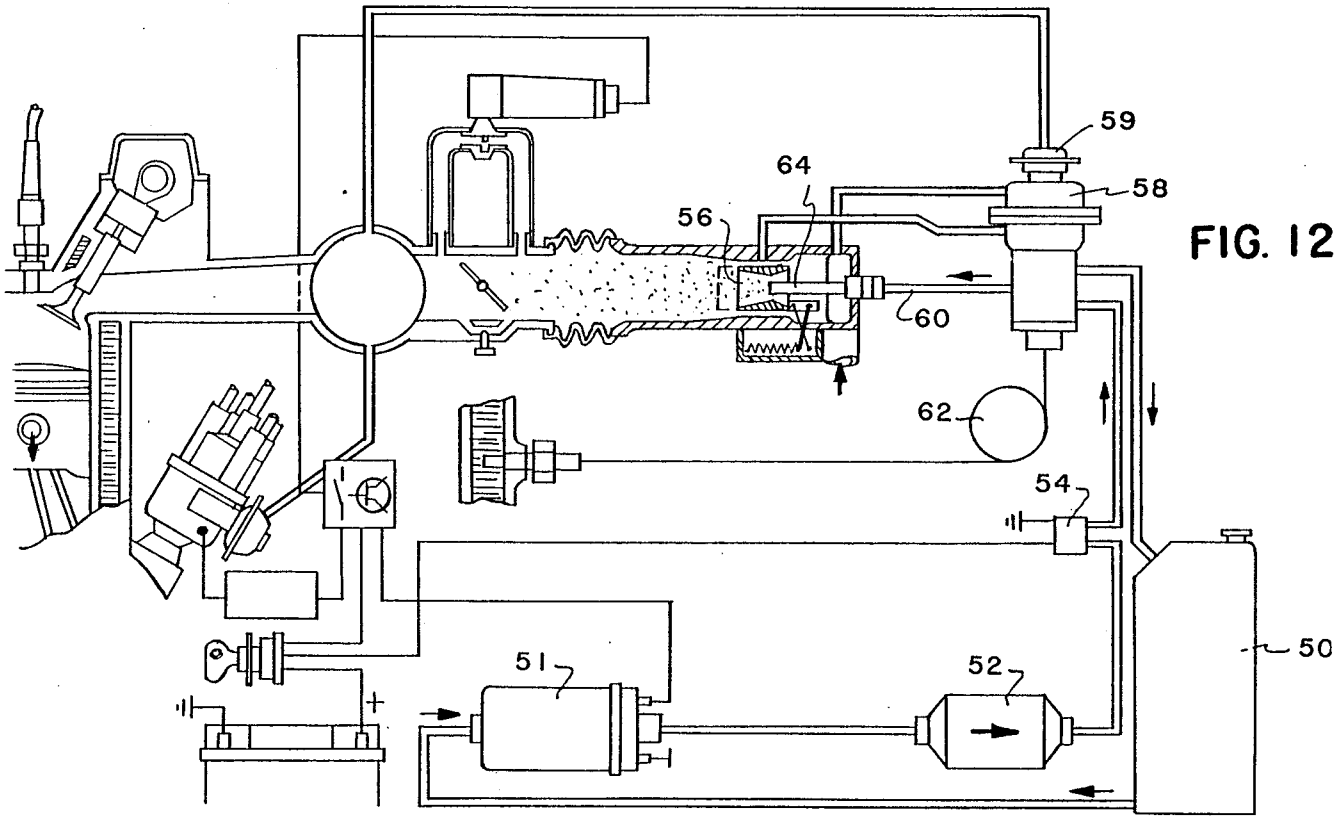
FIG. 12 is similar to FIG. 11, except that it uses a single nozzle injector in place of multi-port injectors.

FIG. 12 is a schematic diagram of a Single Point Continuous Fuel Injection System as in FIG. 11 with the important exception that multi-port injectors are replaced by "one" nozzle injector 64 that discharges into the center of the "floating" Venturi meter, thereby obtaining the advantage of vaporizing-homogenizing environment and time for gasifying before equalized distribution from one less critical mechanical nozzle injector.

A fluid servo system in accordance with the invention is not limited to fuel injection; for in practice, the first fluid which produces an input force may be air or liquid, and the valve mechanism activated by this input force to produce a regulated output pressure may be a gas or liquid for operating pneumatic or hydraulic devices.

Although there have been shown and described preferred embodiments of fluid servo systems for proportionate regulation of one fluid's pressure flow to another fluid's mass-volume of flow in accordance with the invention, it will be appreciated that many changes and modifications may be made therein without, however, departing from the essential spirit thereof.

I claim:

1. A fluid servo system comprising:

a first fluid constant pressure source;

a signal force derived from and proportional to the varying flow rate of a second fluid and;

a valve mechanism having a valve member which is activated by said signal force displacing it to an extent determined by the strength of this force the mechanism including an input port coupled to said first fluid source, a return port coupled to a source reservoir, an output chamber coupled to an inflow port, an exhaust port, a countervailing pressure chamber, and a discharge outlet; the prevailing pressure of the source fluid in said output chamber being determined by the position of said valve member which when displaced in one direction simultaneously opens said inflow port and closes off said exhaust port, thereby increasing fluid pressure in said output chamber and in reverse decreasing fluid pressure by controlling the rate of inflow and exhaust from said output chamber, whereby the prevailing pressure in said output chamber being applied to said valve member as a countervailing force to said signal force causes said valve member to seek and assume a equilibrium position at which the forces are balanced and the resultant mean fluid pressure of the source fluid yielded from said discharge outlet is proportional to said signal force.

2. A fluid servo system as set forth in claim 1, wherein said valve mechanism includes a ported sleeve, a valve member slideably mounted within said sleeve, an output chamber and a countervailing pressure chamber; said valve member, including a stem on which are mounted first, second, and third cylinders at annular spaced positions wherein the space between the first and second cylinders defines an inflow passage between an input port and an inflow port in said sleeve, and the space between the second and the third cylinder defines a return passage between an exhaust port and a return port in said sleeve, said spaces between the cylinders defined whereby said valve member is axially displaced relative to said sleeve ports, said inflow passage being continuously open to said input port, said return passage being continuously open to said return port, said cylinders and said inflow and exhaust ports leading to said output chambers are located and dimensioned such that the displacement of said valve member by said signal force causes said first cylinder to gradually open said inflow port and said third cylinder to gradually close said exhaust port thereby increasing fluid pressure in said output chamber and in a chamber enclosing said sleeve below said first cylinder, whereby said output chamber pressure also acts upon the surface of said first cylinder counteracting said signal force on said valve member to close said inflow port and open said exhaust port and the opposing forces seek balance by positioning said valve member thereby establishing the pressure of source fluid in said output chamber proportionate to the instant value of said signal force.

3. A valve mechanism as set forth in claim 2, wherein said signal force is applied to said valve member at the third cylinder end, and said countervailing pressure chamber below the first cylinder of said valve member further includes a spring located in said countervailing pressure chamber to apply a bias to said valve member.

4. A fluid servo system as set forth in claim 1, wherein said first fluid is a fuel and the second fluid is air from which the signal force is derived.

5. A fuel injection system for internal combustion engines comprising the fluid servo system as set forth in claim 4, wherein the second fluid is intake air to the engine and the first fluid, being pressure controlled, is a fuel whereby the controlled output pressure of said fuel is discharged into the intake air through one or more throttling injectors yielding a fuel flow rate proportional to intake air flow in optimum ratio throughout the range of intake air flow.

6. A fuel injection system as set forth in claim 5 wherein said signal force is derived from an air meter that outputs a differential-pressure signal proportional to the mass-volume flow of intake air.

7. A fluid servo system as set forth in claim 1 wherein the first fluid is either gas or liquid and the second fluid is either gas or liquid and said signal force is derived from an electric or mechanical flow meter of the second fluid.

8. A fluid servo system as set forth in claim 1, wherein said signal force is transduced from electric, pneumatic or hydraulic control systems and the first fluid is air, gas or liquid whereby the controlled pressure output of said first fluid is applied to the closed end of flow rate devices such as cylinder enclosed pistons and fluid motors.

9. A fluid servo system as set forth in claim 8, wherein the maximum signal pressure is less than the maximum pressure of the source fluid, said signal pressure is amplified by applying said signal pressure to a diaphragm or piston whose cross-sectional area is a multiple of the cross-sectional area of said first cylinder of said valve member and said diaphragm or piston is coupled to said valve member's third cylinder to equate with the output pressure applied to said valve member's first cylinder.

10. A boosted servo system consisting of a system as set forth in claim 9 as the primary system whereby the controlled output of a low pressure source fluid is coupled to the signal force input of a second fluid servo system as set forth in claim 9 and the fluid input to said second servo system is a constant high pressure fluid source whereby the controlled high pressure output from said second system is proportionate to the varying signal force applied to said primary system.

* * * * *